US009297603B2

(12) United States Patent
Graber

(10) Patent No.: US 9,297,603 B2
(45) Date of Patent: Mar. 29, 2016

(54) INFLATABLE BAG WITH BURST CONTROL ENVELOPE AND GAS GENERATOR

(71) Applicant: Curtis E. Graber, Woodburn, IN (US)

(72) Inventor: Curtis E. Graber, Woodburn, IN (US)

( * ) Notice: Subject to any disclaimer, the term of this patent is extended or adjusted under 35 U.S.C. 154(b) by 0 days.

(21) Appl. No.: 14/543,490

(22) Filed: Nov. 17, 2014

(65) Prior Publication Data

US 2015/0068423 A1 Mar. 12, 2015

Related U.S. Application Data

(62) Division of application No. 13/529,489, filed on Jun. 21, 2012, now Pat. No. 8,887,639.

(51) Int. Cl.

| | |
|---|---|
| ***F42B 27/00*** | (2006.01) |
| ***F41A 33/04*** | (2006.01) |
| ***F42B 3/04*** | (2006.01) |
| ***F42B 12/36*** | (2006.01) |

(52) U.S. Cl.

CPC . *F41A 33/04* (2013.01); *F42B 3/04* (2013.01); *F42B 12/36* (2013.01); *F42B 27/00* (2013.01)

(58) Field of Classification Search

CPC ..... F41A 33/04; F42B 12/36; F42B 12/46; F42B 12/50; F42B 27/00

USPC ..... 102/355, 482, 498, 529, 367, 368; 181/116, 117, 118, 119; 446/188, 220, 446/221, 222, 223, 224, 225, 226

See application file for complete search history.

(56) References Cited

U.S. PATENT DOCUMENTS

| | | | | |
|---|---|---|---|---|
| 1,300,640 | A | 4/1919 | Pasternak | |
| 1,356,817 | A | 10/1920 | Gregory | |
| 3,039,559 | A | 6/1962 | Ellsworth | |
| 3,528,662 | A * | 9/1970 | Engle | F42B 12/362 473/577 |
| 4,634,395 | A | 1/1987 | Burchett | |
| 4,781,645 | A | 11/1988 | Kato | |
| 4,834,382 | A | 5/1989 | Spector | |
| 4,857,029 | A | 8/1989 | Dierick et al. | |
| 5,041,046 | A | 8/1991 | Nakamura et al. | |
| 5,249,527 | A | 10/1993 | Schwind | |
| 5,370,161 | A | 12/1994 | Shafer | |
| 6,324,955 | B1 | 12/2001 | Andersson et al. | |
| 6,373,384 | B1 | 4/2002 | Ferguson et al. | |
| 6,477,979 | B1 | 11/2002 | Sanchez | |
| 6,488,557 | B1 | 12/2002 | Elliott et al. | |
| 6,490,978 | B1 | 12/2002 | Perotto et al. | |
| 6,545,092 | B2 | 4/2003 | Parker | |
| 6,688,555 | B1 | 2/2004 | Kneisl | |
| 7,013,810 | B1 * | 3/2006 | Brydges-Price | F42B 12/54 102/502 |

(Continued)

OTHER PUBLICATIONS

Casidy et al., Gas Laws Save Lives: The Chemistry Behind Airbags, Oct. 2000, http://www.chemistry.wustl.edu/~edudev/LabTutorials/Airbags/airbags.html.

*Primary Examiner* — Gabriel Klein
(74) *Attorney, Agent, or Firm* — Taylor IP, P.C.

(57) ABSTRACT

A rupturable bag assembly including a balloon, an outer wall, an inlet port, and a heat resistant shield. The balloon is fabricated from an elastic material. The outer wall is disposed around the balloon, the outer wall having a perimeter seam which parts abruptly at a predetermined tension. The inlet port passes through the outer wall into the balloon for inflating the balloon to produce the predetermined tension. The heat resistant shield is disposed within the balloon opposite the inlet port. The outer wall is constructed of a relatively inelastic material in comparison to the material used to construct the balloon.

5 Claims, 9 Drawing Sheets

(56) References Cited

U.S. PATENT DOCUMENTS

| | | | | |
|---|---|---|---|---|
| 7,412,929 | B2 | 8/2008 | Walsh | |
| 7,958,827 | B1 * | 6/2011 | Brock | F41A 33/04 102/498 |
| 8,117,966 | B1 | 2/2012 | Graber | |
| 2006/0043712 | A1 | 3/2006 | Hakki et al. | |
| 2006/0166171 | A1 | 7/2006 | Preston et al. | |
| 2007/0169658 | A1 | 7/2007 | Brock | |
| 2010/0269966 | A1 | 10/2010 | Butler | |
| 2012/0288830 | A1 | 11/2012 | Van Zuilen et al. | |

* cited by examiner

FIG. 7A
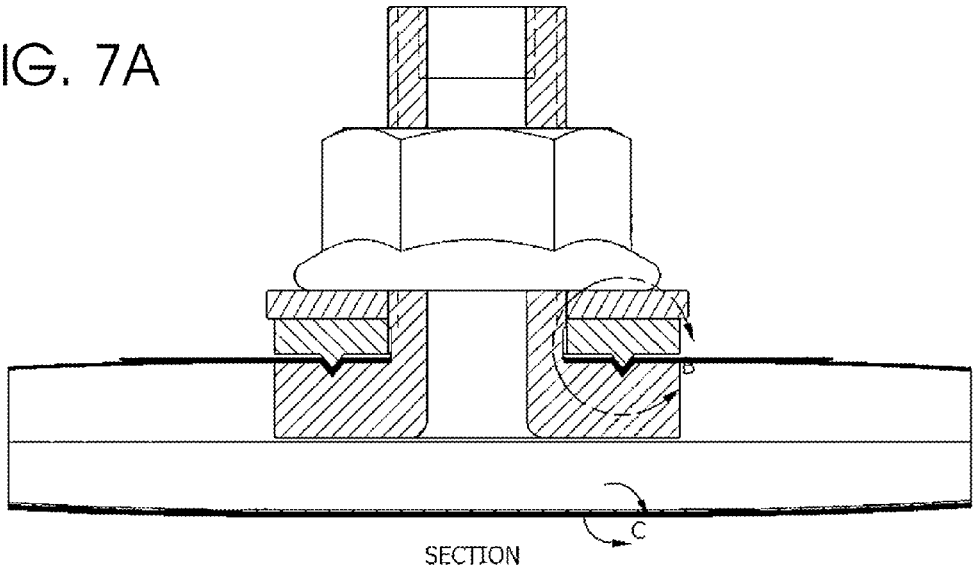
FIG. 7B
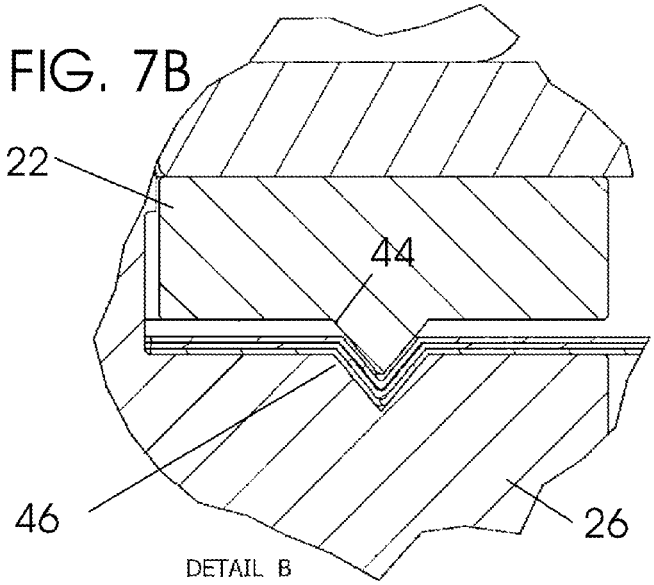
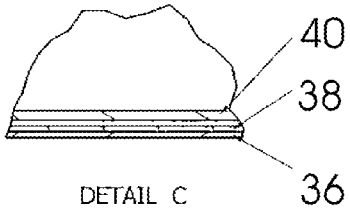
FIG. 7C

INFLATABLE BAG WITH BURST CONTROL ENVELOPE AND GAS GENERATOR

CROSS REFERENCE TO RELATED APPLICATIONS

This is a divisional of U.S. patent application Ser. No. 13/529,489, entitled "INFLATABLE BAG WITH BURST CONTROL ENVELOPE AND GAS GENERATOR", filed Jun. 21, 2012, which is incorporated herein by reference.

BACKGROUND

1. Technical Field

The field relates to inflatable devices such as air bags and more particularly to an air bag having a burst point control envelope with particular application to stun grenades.

2. Description of the Technical Field

U.S. Pat. No. 8,117,966 taught a non-pyrotechnic stun grenade for generating loud, explosive sound by inflation to rupture of an inflatable bag. To make the point of rupture consistent from bag to bag and to achieve target noise levels within a limited time period the '966 patent proposed to construct a single layer inflatable bag with a rupture seam. Upon inflation the rupture seam parted abruptly at a particular and predetermined degree of tension on the seam. The rupture seam parted at a design volume of the bag and pressure within the bag to produce an N-wave. The explosive sound produced consistently met a minimum target volume level. Although the '966 patent provided for a non-pyrotechnic, compressed air, inflation source the patent suggests that pyrotechnic gas generation more readily produced high gas flow rates than compressed gas sources.

The use of chemical reactions to generate gas generators for inflation of automotive air bags is known. One issue addressed during the development of such air bags was the type of gas generator to use. Among the concerns was the byproducts produced by the chemical reactions or combustion of the fuel source used to generate the gas.

A popular contemporary gas generator for automotive applications is a mixture of sodium azide ($NaN_3$), potassium nitrate ($KNO_3$) and silicon dioxide ($SiO_2$). An exothermic (heat producing) decomposition of sodium azide into nitrogen gas and sodium can be initiated by exposure of the compound to 300° C. The free nitrogen gas inflates the bag while the potassium nitrate reacts with the sodium in a second reaction to produce potassium oxide ($K_2O$), sodium oxide ($Na_2O$) and more free nitrogen ($N_2$). A final reaction translates the reactive potassium oxide and sodium oxide compounds into more stable byproducts by a reaction with the silicon dioxide to produce potassium silacate and sodium silicate ($K_2O_3Si$ an $Na_2O_3Si$). These are chemically stable compounds which pose no known environmental and health threat. See *Gas Laws Save Lives: The Chemistry Behind Airbags*, Casiday, R. and Frey, R. (2000). In addition, the initiating materials are not hygroscopic as water absorption can slow or stop gas generating reactions limiting the shelf life of units. Alternative pyrotechnic formulations for a gas generator may make use of potassium nitrite ($KNO_2$). Such fuel sources result in reactions which are highly exothermic and can produce higher temperatures than the reaction based on sodium azide.

Construction of an inflatable bag which ruptures at a consistent degree of inflation to produce predictable noise levels using an exothermic chemical reaction to produce the inflation gas poses issues not present when a compressed air source is used. In contrast, where a compressed gas source is used for inflation the temperature of compressed gas falls upon expansion.

SUMMARY

A rupturable bag assembly including a balloon, an outer wall, an inlet port, and a heat resistant shield. The balloon is fabricated from an elastic material. The outer wall is disposed around the balloon, the outer wall having a perimeter seam which parts abruptly at a predetermined tension. The inlet port passes through the outer wall into the balloon for inflating the balloon to produce the predetermined tension. The heat resistant shield is disposed within the balloon opposite the inlet port. The outer wall is constructed of a relatively inelastic material in comparison to the material used to construct the balloon.

An inflation port is provided from outside into the rupturable bag through the first sections of the outer and inner walls to deliver gas into the rupturable bag and against the heat resistant shield.

An inflation gas generator and flow arrester assembly is fitted to the inflation port outside of the rupturable bag.

BRIEF DESCRIPTION OF THE DRAWINGS

FIG. 7A is an cross sectional view of mating of an air inlet with the rupturable bag.

FIG. 7B is a detail view of clamping the bag with the air inlet.

FIG. 7C is detail of the rupturable bag upper wall.

DETAILED DESCRIPTION

Figure 1:
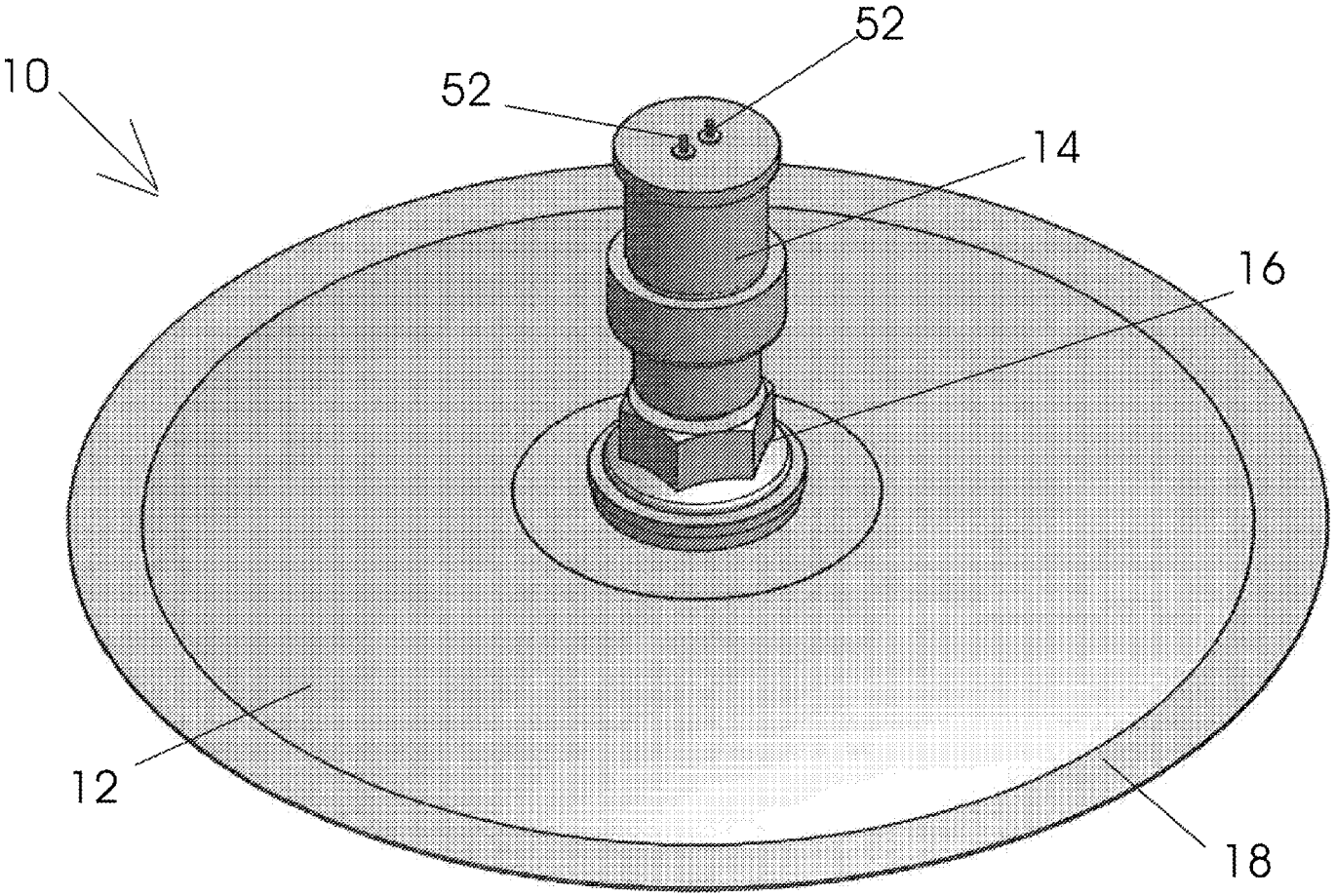
FIG. 1 is a perspective view of a rupturable bag assembly for a stun grenade.

In the following detailed description, like reference numerals and characters may be used to designate identical, corresponding, or similar components in differing drawing figures. Furthermore, example sizes/models/values/ranges may be given with respect to specific embodiments but are not to be considered generally limiting.

Referring now to the figures and in particular to FIG. 1, a self-inflating rupturable bag assembly 10 is shown. Rupturable bag assembly 10 may conceptually be divided into two sections, a rupturable bag 12 and an inflation gas generator assembly 14 which is mounted to bag inflation port 16. Rupturable bag 12 parts along a perimeter seam 18 upon inflation to a minimum pressure and tension on the seam. The rupturable bag assembly 10 may be used with a variety of stun grenades to generate an explosive sound. A pair of electrical studs 52 allow connection to an electrical circuit which may be used to ignite a fuel source located in the inflation gas generator assembly 14.

Figure 2:
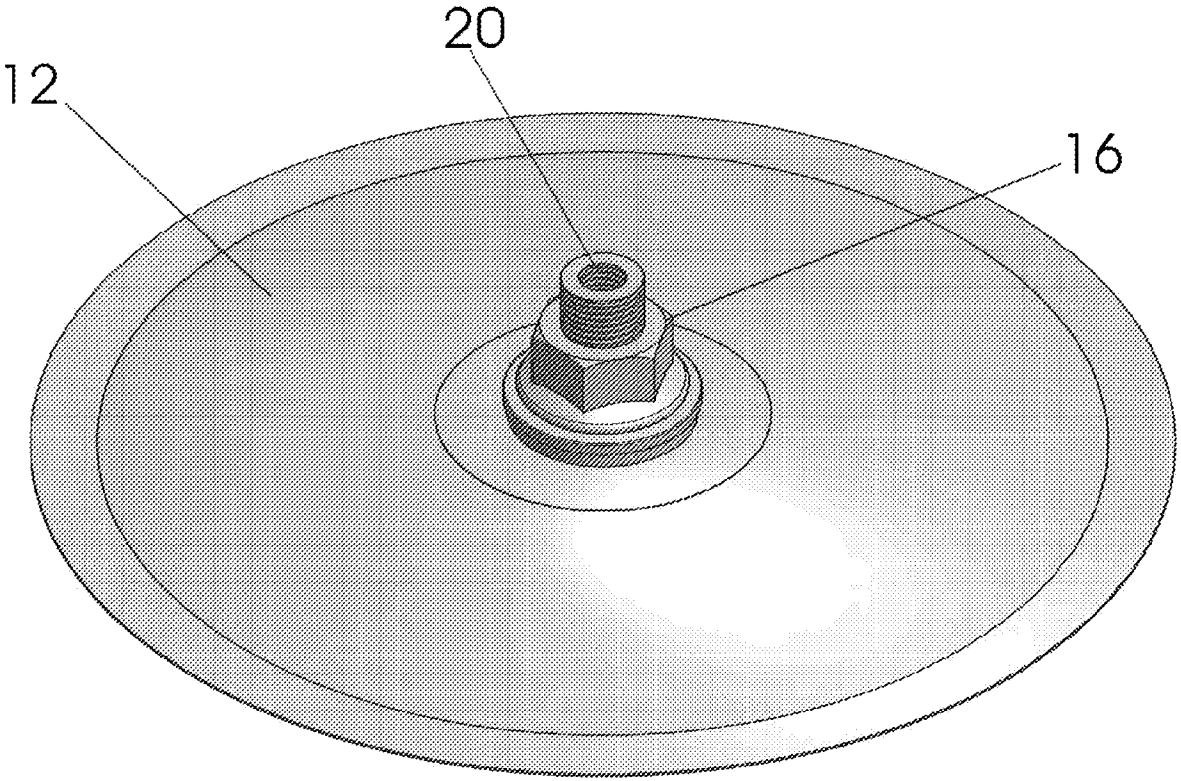
FIG. 2 is a perspective view of a rupturable bag.
Figure 4:
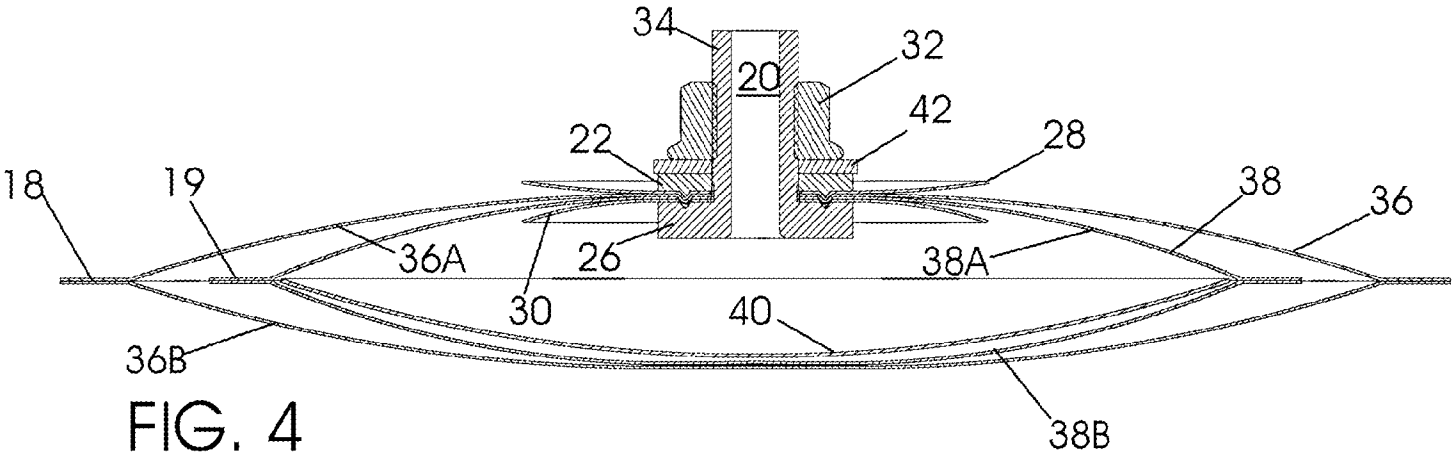
FIG. 4 is a cross section view of the rupturable bag of FIGS. 2 and 3.
Figure 3:
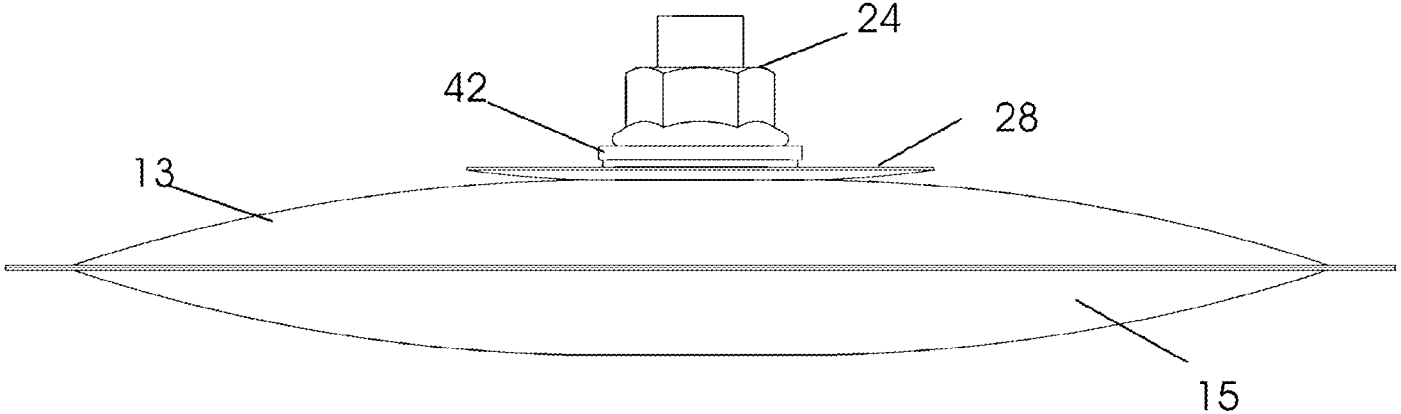
FIG. 3 is a side elevation of the rupturable bag of FIG. 2.
Figure 5:
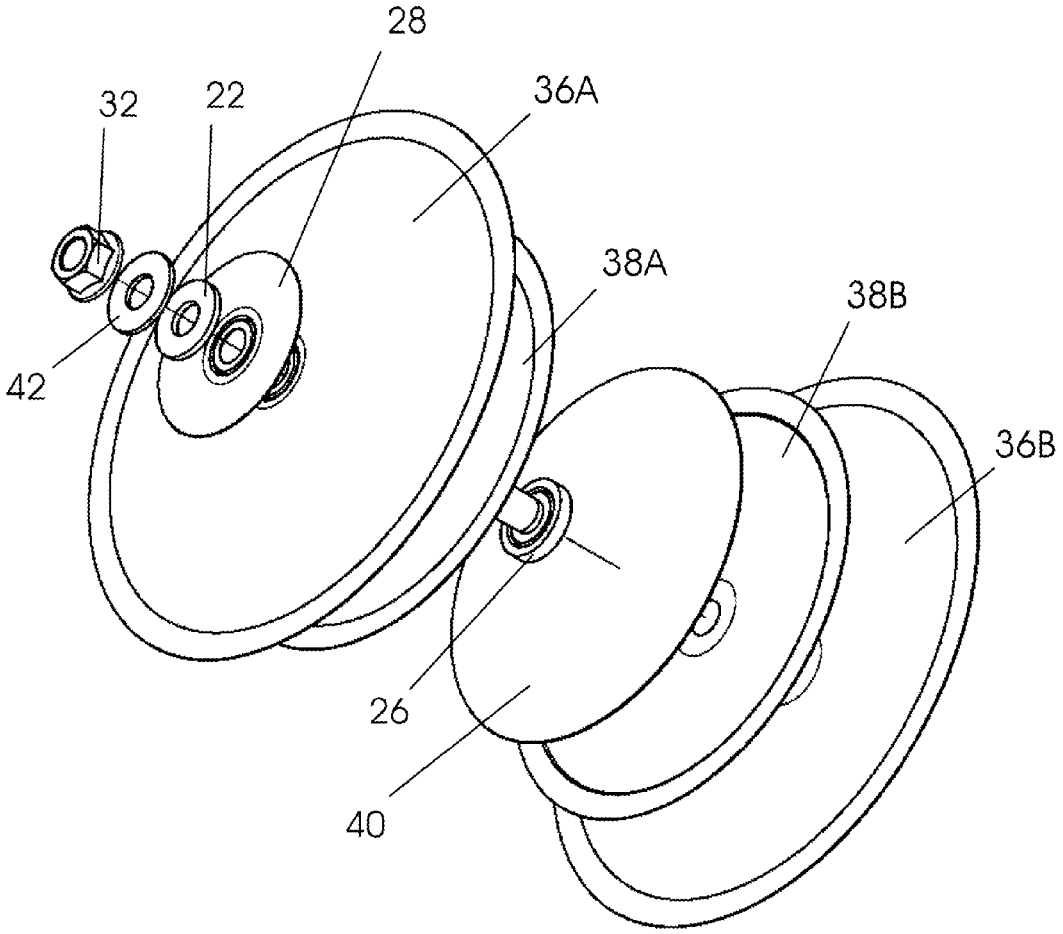
FIG. 5 is an exploded perspective view of the rupturable bag.
Figure 6:
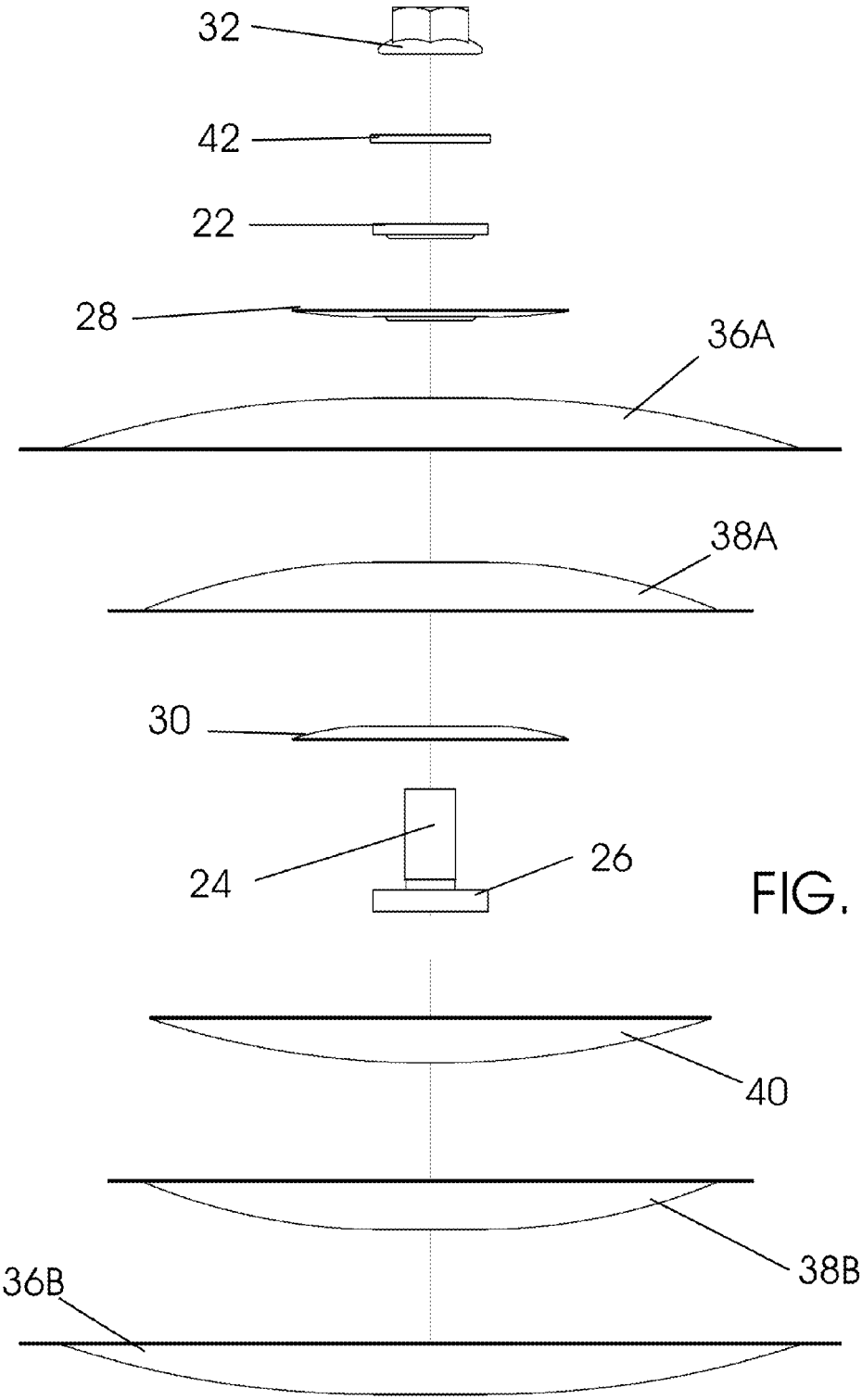
FIG. 6 is an exploded side view of the rupturable bag.
Figure 8A:
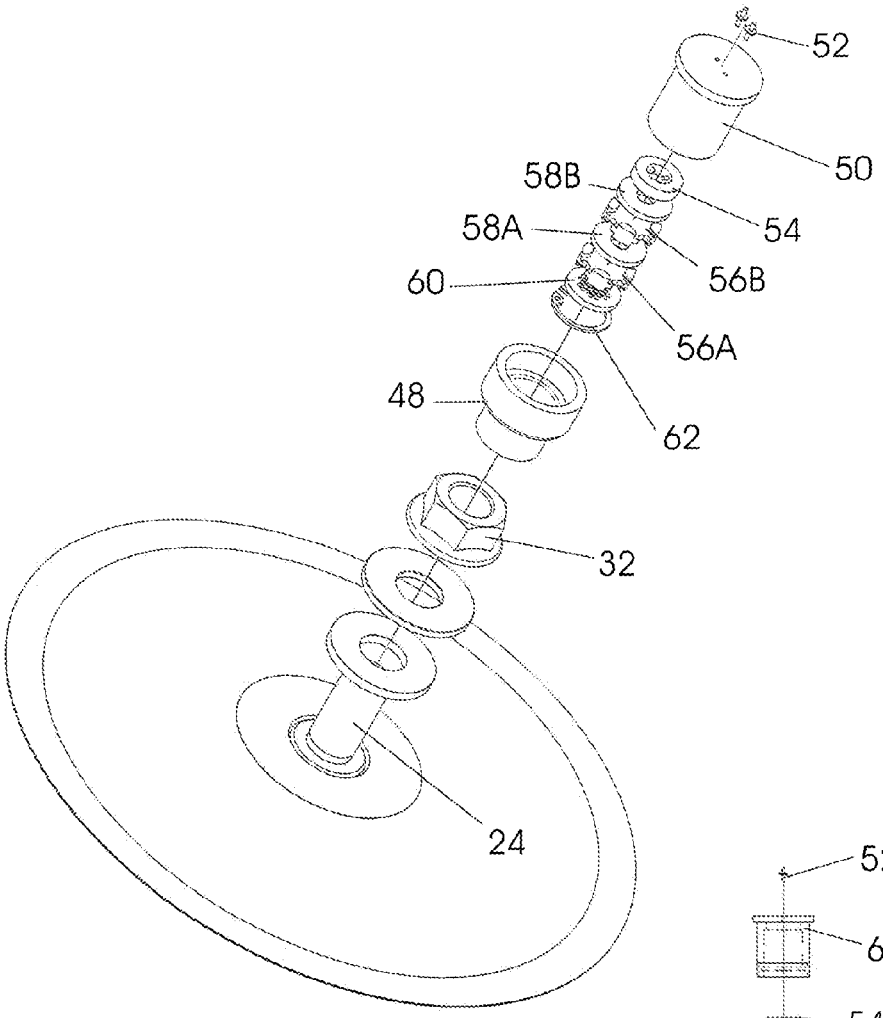
FIGS. 8A and 8B are exploded perspective and side views of the rupturable bag assembly.
Figure 8B:
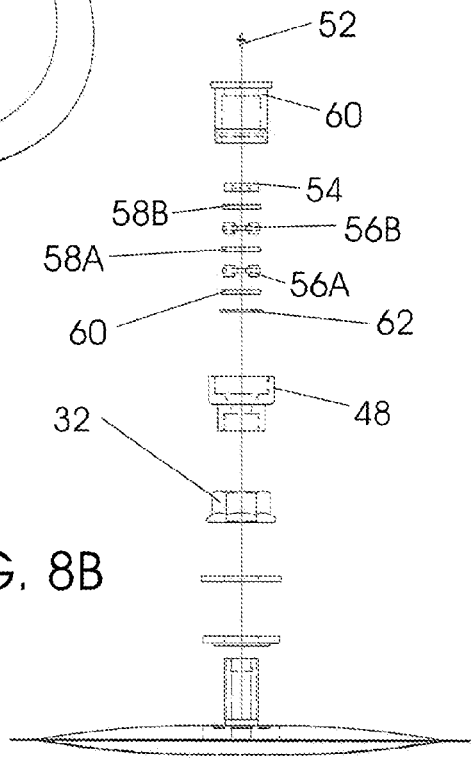
Figure 9:
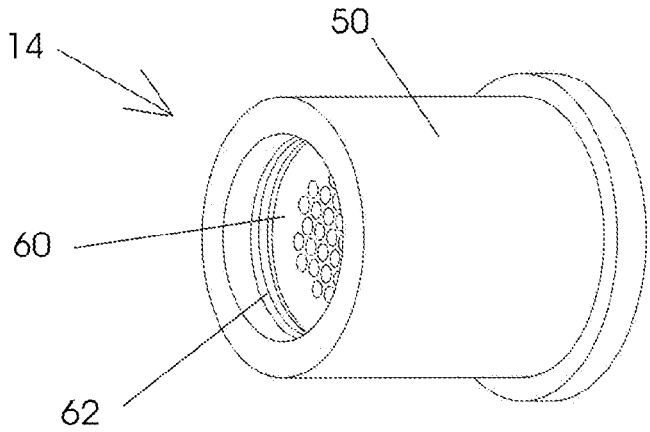
FIG. 9 is a perspective view of the pressurization gas arrester for the rupturable bag assembly.
Figure 10:
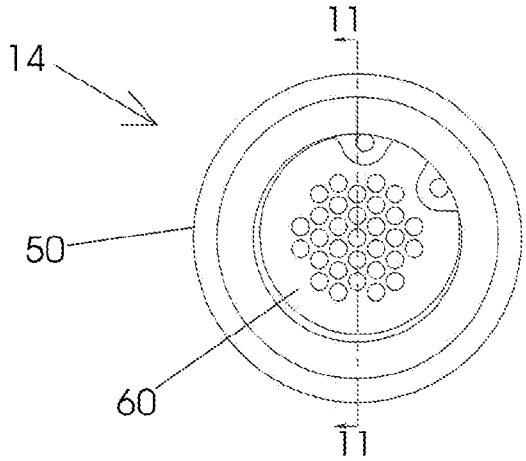
FIG. 10 is a top view of the gas arrester.
Figure 11:
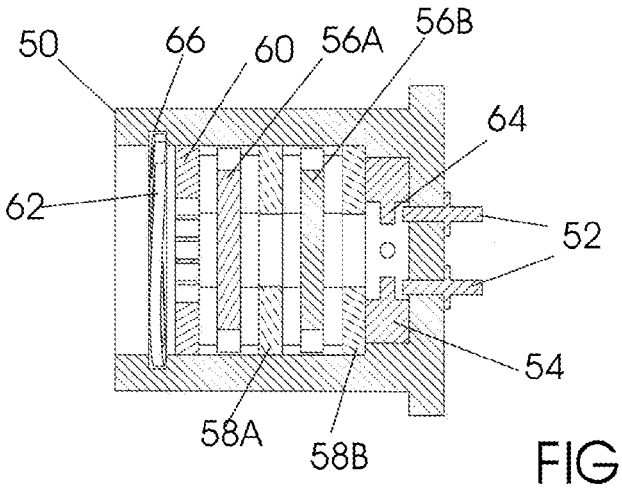
FIG. 11 is a cross-sectional view of the gas arrester taken along section lines 11-11 of FIG. 10.
Figure 12A:
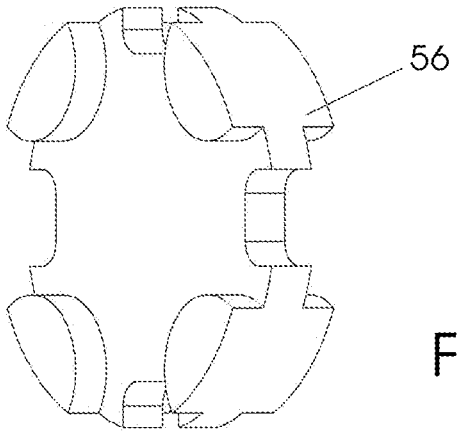
FIGS. 12A, B and C are detail views of a assembly washer for the gas arrester.
Figure 12B:
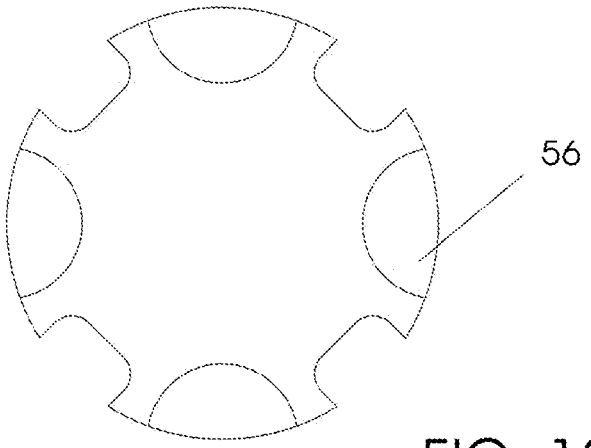
Figure 12C:
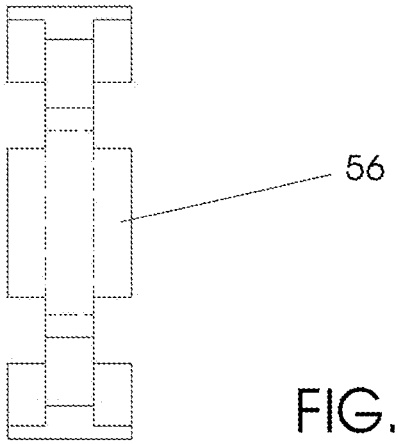

In FIG. 2 the rupturable bag 12 is shown with inflation gas generator assembly 14 detached to better show inflation port 16. The upper portion of inflation port 16 is threaded for attachment to the inflation gas generator assembly 14 and provides an inlet 20 disposed through its center. Inflation gas is introduced to rupturable bag 12 via inlet 20.

The details of construction of rupturable bag 12 are shown in FIGS. 3-6. Inflation port 16 is a multiple element assembly extending through an upper wall of rupturable bag 12. The inflation port 16 incorporates a conduit 34 which is flattened and thickened at one end to form an inner bulkhead 26. Conduit 34 extends through a first of two walls 13, 15 of rupturable bag 12 which places inner bulkhead between the two walls, inside an assembled an assembled rupturable bag 12.

Located between the inner bulkhead 26 and the first wall 13 is an inner collar 30. Outside of first wall 13 is an outer collar 28. Adjacent the outer collar 28 moving along conduit 34 is a washer 42. The collars 30, 28, clamp washer 22 and washer 42 are held in place by a nut 32 which is threaded onto the conduit 34.

The rupturable bag 12 comprises first and second walls 13, 15. The rupturable bag 12 also comprises an inner elastic balloon 38 and an outer reinforced envelope 36. The material of the outer envelope 36 is less elastic than the material used to construct the inner balloon 38. A nylon weave fabric would be suitable. Both the inner elastic balloon 38 and the outer reinforced envelop 36 are constructed from first and second layers, in the case of the inner elastic balloon, first and second layers 38A and 38B, and in the case of the outer reinforced envelope 36, first and second layers 36A and 36B. The halves of inner elastic balloon 38 are closed along seam 19. The halves of outer reinforced envelope 36 are closed along seam 18. Seam 18 is constructed to part upon application of pressure from within. Failure of seam 18 results in a cascade failure of inner elastic balloon 38. Seam 18 may be constructed in a number of ways. Where closed mesh, rip stop (a type of weave) nylon is used as a fabric from which outer reinforced envelop 36 is constructed. The seam 18 may be formed using braided nylon or polyester with a typical strength range of 20 to 50 lbs. tensile strength stitching the two halves together. A zig-zag stitch allows the use of lower tensile strength materials for the burst envelope and the seam than a straight stitch allows. The inner elastic balloon may be made with vinyl with the halves welded together. Welding may be done a number of ways, for example, sonically, chemically or radio frequency welded. Adhesives and heat bonding are also possible. In this way a volumetrically small envelope can be constructed which can be inflated to a target burst pressure of 375 psi. A bag having a diameter of 5 inches on inflation producing a 180 dB peak over pressure shock wave on rupture can be built. Such a bag can be inflated to rupture in 20 to 30 milliseconds using a sodium azide or similar gas source.

Applied to the inner face of second layer 38B of inner elastic balloon 38 is a heat shield layer 40, which may be constructed of aluminum foil of mylar. Heat shield layer 40 is used to prevent premature failure of rupturable bag 12 due to ejection of hot gas from inlet 20.

FIGS. 7A-C illustrate of the juncture between inlet port assembly 16 and the first wall 13 of rupturable bag 12 and of the second wall 15 of the rupturable bag. The clamp washer 22 carries an annular dimple 44 on one face displaced outwardly from the conduit 24. Annular dimple 44 aligns on and is shaped to conform to an annular depression 46 on the adjacent face of inner bulkhead 26. The first wall 13 of the rupturable bag 12 is pinched between the inner bulkhead 26 and the clamp washer 22. Adhesive layers may be used between wall elements in the area of the clamp washer 22 to improve sealing.

FIGS. 8-12 illustrate construction of the inflation gas generator assembly 14. Gas arrester assembly 14 includes a housing/body 50 which is essentially a tube which is open an one end, closed at the other. The open end of the body 50 is mated with a connector 48 fitted between the inflation gas generator assembly 14 and the inflation port 16. Connecter 48 is fitted to conduit 24 outside nut 32 on the exposed end of the conduit relative to the rupture bag 12. The remaining elements of the inflation gas generator assembly 14, excluding a pair of electrical studs 52, are located in the housing 50. The electrical studs 52 pass through the housing to allow application of an electrical trigger signal from outside the housing to a fuel source 54 located in the housing 50.

Combustion of fuel source 54, which may be a dry, packed blend of sodium azide, silicon dioxide and potassium nitrate, results in a jet of high temperature gas being ejected from the open end of the inflation gas generator assembly 14 into a connector 48 between the assembly 14 and the inlet 20 of the inflation port 16. Fuel source 54 is shaped an a ring with a plurality of radial connecting rods 64 aimed inwardly on the ring for connection to the electrical studs 52 by wires (not shown). As an alternative to a fuel source including sodium azide, more conventional pyrotechnic fuel sources may be used, typically incorporating potassium nitrite. To protect the elastomeric and fabric layers of the rupturable bag 12 from the full force and heat of gas ejected from the gas generator assembly 14 the path from fuel source 54 to connector 48, while axial, is not direct. A variety of trigger mechanisms may be used, particularly where an electronic trigger signal is provided.

Upon assembly of inflation gas generator assembly 14 the fuel source 54 is located deepest in the housing 50, proximate to the closed end of the housing and distal to its open end. Moving toward the open end of housing 50 a lower washer 58B is located having a central annular opening through which gas is ejected. Next in line is a lower spacing washer 56B which defines openings between its perimeter edge and the inner wall of the housing 58B. Spacing elements are constructed into the lower spacing washer 56B so that gas can pass from the central annular opening of washer 58B to the perimeter openings. This cycle is repeated once with an upper washer 58A and an upper spacing washer 56A. The lower and upper spacing washers 56B and 56A are illustrated in detail in FIGS. 12A-C generally at reference numeral 56. Washers 58A, 58B, 56A and 56B, along with top cap 60, provide a flame arresting function the fuel source 54 and the inlet port 20. A more extensive flame arresting system incorporating additional washers of alternating types may be employed for pyrotechnic devices as the target temperature range in the rupture envelope is below 100 to 125 degrees Celsius.

Gas is ejected from housing 50 through a perforated top cap 60. Top cap 60 is retained in housing 50 using a spring spacing ring 62 which fits in an annular slot 66 in the inner wall of the housing proximate to the open end of the housing.

What is claimed is:

1. A rupturable bag assembly for producing an acoustic shockwave comprising:

a balloon fabricated from an elastic material;

an outer wall disposed around the balloon, the outer wall having a perimeter seam which parts abruptly at a predetermined tension to produce an acoustic shockwave having a minimum target noise level at a prescribed distance;

an inlet port through the outer wall into the balloon for inflating the balloon to produce the predetermined tension;

a heat resistant shield disposed within the balloon opposite the inlet port; and the outer wall being constructed of a relatively inelastic material in comparison to the material used to construct the balloon.

2. The rupturable bag assembly of claim 1, further comprising:

an inflation assembly including a triggerable chemical gas source coupled to the inlet port.

3. The rupturable bag assembly of claim 2, further comprising:

a configurable flame arrester located between the triggerable chemical gas source and the inlet port.

4. The rupturable bag assembly of claim 3, wherein the triggerable chemical gas source is a pyrotechnic.

5. The rupturable bag assembly of claim 3, wherein the triggerable chemical gas source includes sodium azide, potassium nitrate and silicon dioxide.

* * * * *